US009393663B2

(12) United States Patent
Volk

(10) Patent No.: US 9,393,663 B2
(45) Date of Patent: Jul. 19, 2016

(54) MEASURING DEVICE

(75) Inventor: Raimund Volk, Villingen-Schwenningen (DE)

(73) Assignee: HOMMEL-ETAMIC GmbH, Villingen-Schwenningen (DE)

( * ) Notice: Subject to any disclaimer, the term of this patent is extended or adjusted under 35 U.S.C. 154(b) by 30 days.

(21) Appl. No.: 13/214,764

(22) Filed: Aug. 22, 2011

(65) Prior Publication Data

US 2012/0043961 A1 Feb. 23, 2012

(30) Foreign Application Priority Data

Aug. 23, 2010 (DE) ..... 10 2010 035 147

(51) Int. Cl.
*G01B 7/30* (2006.01)
*B24B 5/42* (2006.01)
*B24B 49/04* (2006.01)

(52) U.S. Cl.
CPC ..... *B24B 5/42* (2013.01); *B24B 49/045* (2013.01)

(58) Field of Classification Search
CPC ..... B24B 49/045; B24B 5/42; G01B 7/30; G01B 3/56; G01B 7/023; G01P 15/14; G01P 3/487; G01N 17/02; G01D 11/245
USPC ..... 324/207.11–207.26; 33/534, 555.1
See application file for complete search history.

(56) References Cited

U.S. PATENT DOCUMENTS 1,425,283 A 8/1922 Pratt
1,557,903 A 10/1925 Tornberg
1,815,049 A 7/1931 Cole
1,892,005 A 12/1932 Richmond
1,941,456 A 1/1934 Arnold et al.
2,408,672 A 10/1946 Mennesson
2,603,043 A 7/1952 Bontemps
2,789,354 A 4/1957 Polidor et al.
2,909,873 A 4/1957 Fisk
2,949,708 A 8/1960 Butterworth et al.
3,157,971 A 11/1964 Snyder (Continued)

FOREIGN PATENT DOCUMENTS

CH 660 629 A5 5/1987
DE 88446 3/1972

(Continued)

OTHER PUBLICATIONS

Michelle Clifford and Leticia Gomez, Measuring Tilt with Low-g Accelerometers May 2005 Freescale Semiconductor.*

(Continued)

*Primary Examiner* — Son Le
*Assistant Examiner* — Brent J Andrews
(74) *Attorney, Agent, or Firm* — Shlesinger, Arkwright & Garvey LLP

(57) ABSTRACT

Measuring device, in particular for in-process measurement of test pieces during a machining operation on a machine tool, in particular a grinding machine, has a measuring head which is movable relative to a base body of the measuring device between a neutral position and a measuring position in which the measuring head is in measuring contact with the test piece. At least one angle sensor is associated with the measuring head for detecting the angular position of the measuring head, in particular changes in the angular position of the measuring head relative to the test piece, during a measuring operation.

10 Claims, 8 Drawing Sheets

(56) References Cited

U.S. PATENT DOCUMENTS

| | | | |
|---|---|---|---|
| 3,274,693 | A | 9/1966 | Witzke |
| 3,321,869 | A | 5/1967 | Parrella et al. |
| 3,352,022 | A | 11/1967 | Fisk |
| 3,352,065 | A | 11/1967 | Enkelmann |
| 3,386,178 | A | 6/1968 | Arnold et al. |
| 3,552,820 | A | 1/1971 | Brachvogel |
| 3,603,044 | A | 9/1971 | Price |
| 3,648,377 | A | 3/1972 | Witzke |
| 3,663,190 | A | 5/1972 | Fisk |
| 3,688,411 | A | 9/1972 | Asano et al. |
| 3,694,970 | A | 10/1972 | Schoonover et al. |
| 3,777,441 | A | 12/1973 | Kurimoto et al. |
| 3,793,775 | A | 2/1974 | Ishikawa et al. |
| 3,802,087 | A | 4/1974 | Raiteri |
| 3,863,352 | A | 2/1975 | Peonski |
| 3,987,552 | A | 10/1976 | Raiteri |
| 4,106,241 | A | 8/1978 | Fisk |
| 4,141,149 | A | 2/1979 | George et al. |
| 4,175,462 | A | 11/1979 | Simon |
| 4,351,115 | A | 9/1982 | Possati |
| 4,394,683 | A | 7/1983 | Liptay-Wagner et al. |
| 4,414,748 | A | 11/1983 | Gauler et al. |
| 4,429,464 | A | 2/1984 | Burrus |
| 4,437,239 | A | 3/1984 | Possati |
| 4,480,412 | A | 11/1984 | Shank et al. |
| 4,485,593 | A | 12/1984 | Munzing et al. |
| 4,524,546 | A | 6/1985 | Hoover et al. |
| 4,566,763 | A | 1/1986 | Greguss |
| 4,596,076 | A | 6/1986 | Sigg |
| 4,606,130 | A | 8/1986 | Vetter |
| 4,625,413 | A | 12/1986 | Possati et al. |
| 4,637,144 | A | 1/1987 | Schemel |
| 4,651,438 | A | 3/1987 | Hutter et al. |
| 4,679,331 | A | 7/1987 | Koontz |
| 4,807,400 | A | 2/1989 | Corallo et al. |
| 4,819,195 | A | 4/1989 | Bell et al. |
| 4,903,413 | A | 2/1990 | Bellwood |
| 4,958,442 | A | 9/1990 | Eckhardt |
| 4,986,004 | A | 1/1991 | Hartmann et al. |
| 5,021,650 | A | 6/1991 | Rieder et al. |
| 5,054,205 | A | 10/1991 | Danielli |
| 5,058,325 | A | 10/1991 | Pineau |
| 5,077,908 | A | 1/1992 | Moore |
| 5,086,569 | A | 2/1992 | Possati et al. |
| 5,088,207 | A | 2/1992 | Betsill et al. |
| 5,095,634 | A | 3/1992 | Overlach et al. |
| 5,097,602 | A | 3/1992 | Cross et al. |
| 5,099,585 | A | 3/1992 | Liskow |
| 5,123,173 | A | 6/1992 | Possati |
| 5,136,527 | A | 8/1992 | Koretz |
| 5,150,545 | A | 9/1992 | Esteve |
| 5,337,485 | A | 8/1994 | Chien |
| 5,419,056 | A | 5/1995 | Breitenstein |
| 5,473,474 | A | 12/1995 | Powell |
| 5,479,096 | A | 12/1995 | Szczyrbak et al. |
| 5,542,188 | A | 8/1996 | Ertl et al. |
| 5,551,814 | A | 9/1996 | Hazama |
| 5,551,906 | A | 9/1996 | Helgren |
| 5,758,431 | A | 6/1998 | Golinelli |
| 5,761,821 | A | 6/1998 | Laycock |
| 5,771,599 | A | 6/1998 | Uchimura et al. |
| 5,902,925 | A | 5/1999 | Crispie et al. |
| 5,914,593 | A | 6/1999 | Arms et al. |
| 5,919,081 | A | 7/1999 | Hykes et al. |
| 5,956,659 | A | 9/1999 | Spies et al. |
| 5,982,501 | A | 11/1999 | Benz et al. |
| 6,029,363 | A | 2/2000 | Masreliez et al. |
| 6,062,948 | A | 5/2000 | Schiff et al. |
| 6,067,720 | A | 5/2000 | Heilbronner |
| 6,067,721 | A | 5/2000 | Dall'Aglio et al. |
| 6,088,924 | A | 7/2000 | Esteve |
| 6,116,269 | A | 9/2000 | Maxson |
| 6,159,074 | A | 12/2000 | Kube et al. |
| 6,167,634 | B1 | 1/2001 | Pahk et al. |
| 6,256,898 | B1 | 7/2001 | Trionfetti |
| 6,266,570 | B1 | 7/2001 | Hocherl et al. |
| 6,298,571 | B1 | 10/2001 | Dall'Aglio et al. |
| 6,304,827 | B1 | 10/2001 | Blixhavn et al. |
| 6,321,171 | B1 | 11/2001 | Baker |
| 6,415,200 | B1 | 7/2002 | Kato et al. |
| 6,430,832 | B1 | 8/2002 | Dall'Aglio et al. |
| 6,487,787 | B1 | 12/2002 | Nahum et al. |
| 6,487,896 | B1 | 12/2002 | Dall'Aglio |
| 6,490,912 | B1 * | 12/2002 | Volk ..... 73/104 |
| 6,511,364 | B2 | 1/2003 | Ido et al. |
| 6,560,890 | B1 | 5/2003 | Madge et al. |
| 6,568,096 | B1 | 5/2003 | Svitkin et al. |
| 6,643,943 | B2 | 11/2003 | Dall'Aglio et al. |
| 6,711,829 | B2 | 3/2004 | Sano et al. |
| 6,763,720 | B1 * | 7/2004 | Jacobsen et al. ..... 73/602 |
| 6,783,617 | B2 | 8/2004 | Lorenzen |
| 6,848,190 | B2 | 2/2005 | Dall'Aglio et al. |
| 6,931,749 | B2 | 8/2005 | Dall'Aglio |
| 6,952,884 | B2 | 10/2005 | Danielli |
| 6,955,583 | B2 | 10/2005 | Dall'Aglio |
| 7,020,974 | B2 | 4/2006 | Danielli et al. |
| 7,024,785 | B2 | 4/2006 | Dall'Aglio et al. |
| 7,047,658 | B2 | 5/2006 | Danielli et al. |
| 7,607,239 | B2 | 10/2009 | Dall'Aglio et al. |
| 7,665,222 | B2 | 2/2010 | Dall'Aglio |
| 7,690,127 | B2 | 4/2010 | Dall'Aglio et al. |
| 7,954,253 | B2 | 6/2011 | Dall'Aglio et al. |
| 8,286,361 | B2 | 10/2012 | Dall'Aglio et al. |
| 8,336,224 | B2 | 12/2012 | Arnold |
| 8,429,829 | B2 | 4/2013 | Arnold |
| 8,508,743 | B2 | 8/2013 | Keller |
| 8,667,700 | B2 | 3/2014 | Dall'Aglio et al. |
| 2002/0020075 | A1 | 2/2002 | Dall'Aglio et al. |
| 2002/0066179 | A1 | 6/2002 | Hall et al. |
| 2002/0066197 | A1 | 6/2002 | Sano et al. |
| 2002/0155790 | A1 | 10/2002 | Ido et al. |
| 2002/0166252 | A1 | 11/2002 | Dall'Aglio et al. |
| 2003/0009895 | A1 * | 1/2003 | Dall'Aglio ..... 33/555.3 |
| 2003/0056386 | A1 * | 3/2003 | Danielli et al. ..... 33/555.1 |
| 2004/0045181 | A1 | 3/2004 | Dall'Aglio et al. |
| 2004/0055172 | A1 | 3/2004 | Danielli |
| 2004/0137824 | A1 * | 7/2004 | Dall'Aglio ..... 451/8 |
| 2005/0178018 | A1 | 8/2005 | Dall'Aglio et al. |
| 2005/0217130 | A1 | 10/2005 | Danielli et al. |
| 2007/0039196 | A1 | 2/2007 | Dall'Aglio et al. |
| 2008/0155848 | A1 | 7/2008 | Dall'Aglio et al. |
| 2008/0211436 | A1 * | 9/2008 | Dietz et al. ..... 318/135 |
| 2009/0113736 | A1 | 5/2009 | Dall'Aglio et al. |
| 2011/0001984 | A1 | 1/2011 | Keller et al. |
| 2011/0010124 | A1 | 1/2011 | Wegmann |
| 2011/0119943 | A1 | 5/2011 | Arnold |
| 2011/0232117 | A1 | 9/2011 | Arnold |
| 2011/0283784 | A1 | 11/2011 | Seewig |
| 2012/0043961 | A1 | 2/2012 | Volk |
| 2012/0224180 | A1 | 9/2012 | Keller et al. |

FOREIGN PATENT DOCUMENTS

| | | | |
|---|---|---|---|
| DE | 32 32 904 | C2 | 3/1984 |
| DE | 43 20 845 | C1 | 10/1994 |
| DE | 4412682 | | 10/1995 |
| DE | 44 16 493 | A1 | 11/1995 |
| DE | 4419656 | | 1/1996 |
| DE | 297 22 951 | U1 | 4/1998 |
| DE | 100 18 107 | A1 | 10/2001 |
| DE | 69619857 | T2 | 11/2002 |
| DE | 202 14 856 | U1 | 2/2003 |
| DE | 698 09 667 | T2 | 4/2003 |
| DE | 600 15 654 | T2 | 8/2005 |
| DE | 10 2007 031 358 | A | 3/2009 |
| DE | 10 2008 016 228 | A1 | 10/2009 |
| EP | 0 068 082 | A2 | 1/1983 |
| EP | 0105627 | | 4/1984 |
| EP | 0 322 120 | A2 | 6/1989 |
| EP | 0 382 336 | A2 | 8/1990 |
| EP | 0 469 439 | A1 | 2/1992 |
| EP | 0 471 180 | A2 | 2/1992 |
| EP | 0 480 222 | A2 | 4/1992 |
| EP | 0 810 067 | A1 | 12/1997 |

(56) References Cited

FOREIGN PATENT DOCUMENTS

| | | | |
|---|---|---|---|
| EP | 0859689 | A | 8/1998 |
| EP | 0 866 945 | B1 | 9/1998 |
| EP | 0 878 704 | A1 | 11/1998 |
| EP | 0 903 199 | A2 | 3/1999 |
| EP | 1 063 052 | A2 | 12/2000 |
| EP | 1 063 052 | B1 | 12/2000 |
| EP | 1 118 833 | | 7/2001 |
| EP | WO 01/058565 | | 8/2001 |
| EP | WO 01/066306 | | 9/2001 |
| EP | WO 02/070195 | | 9/2002 |
| EP | 1 263 517 | | 12/2002 |
| EP | 1 263 547 | B1 | 12/2002 |
| EP | 1 321 793 | B1 | 6/2003 |
| EP | 1 370 391 | B1 | 12/2003 |
| EP | 1370391 | A | 12/2003 |
| EP | 1 263 547 | B1 | 12/2007 |
| FR | 756177 | | 9/1933 |
| GB | 405 817 | | 2/1934 |
| GB | 1361275 | | 7/1974 |
| GB | 1362996 | | 8/1974 |
| GB | 2086778 | A | 5/1982 |
| GB | 2 161 101 | A | 1/1986 |
| GB | 2 197 477 | A | 5/1988 |
| GB | 2 300 582 | A | 11/1996 |
| JP | 53-4285 | A | 1/1978 |
| JP | 55-6825 | | 12/1979 |
| JP | 55120976 | | 9/1980 |
| JP | 55-156801 | | 12/1980 |
| JP | 59-93844 | U | 6/1984 |
| JP | 59125001 | | 7/1984 |
| JP | 3-66553 | A | 3/1991 |
| JP | 10-118974 | A | 5/1998 |
| JP | 11-513317 | A | 11/1999 |
| WO | WO 83/04302 | | 12/1983 |
| WO | WO 90/00246 | | 1/1990 |
| WO | WO 92/14120 | | 8/1992 |
| WO | WO 94/17361 | | 8/1994 |
| WO | WO 97/12724 | | 4/1997 |
| WO | WO 97/13614 | | 4/1997 |
| WO | WO-A-9712724 | | 4/1997 |
| WO | WO 97/40434 | | 10/1997 |
| WO | WO 99/47884 | | 9/1999 |
| WO | WO 02/070195 | | 9/2002 |
| WO | WO 02/090047 | A1 | 11/2002 |
| WO | 2004/023256 | A2 | 3/2004 |
| WO | WO 2009/003692 | A1 | 1/2009 |

OTHER PUBLICATIONS

Office Action dated Jan. 28, 2011 in German Application No. 10 2010 035 147.4, filed Aug. 23, 2010 (3 pgs.).
U.S. Appl. No. 12/662,813, filed May 2010, Keller et al.
U.S. Appl. No. 12/805,053, filed Jul. 2010, Wegmann.
U.S. Appl. No. 12/923,412, filed Sep. 2010, Arnold.
U.S. Appl. No. 13/041,196, filed Mar. 2011, Keller et al.
U.S. Appl. No. 13/096,375, filed Apr. 2011, Seewig.
U.S. Appl. No. 13/073,625, filed Mar. 2011, Arnold.
"Linear variable differential transformer", Dec. 8, 2013 revision, retrieved on Jan. 14, 2014 at http://en.wikipedia.org/wiki/Linear_variable_differential_transformer (3 pages).
European Search Report in counterpart application No. EP 2 383 541 A1 dated Jul. 13, 2011 (3 pages).
Analog Devics—Small and Thin ±2 g Accelerometer ADXL 322 copyrighted 2007 Analog Devices, Inc. (16 pgs.).
German Office Action, dated Jan. 20, 2014 in German priority application No. 10 2010 025 147.4 (2 pgs.).
Portion of Marposs Catalogue (circa 1970).
Leaflet—Fenar Marposs (1991).
"Crankshaft Gauging Machines," Hommelwerke (1985).
PCT Intl. Search Report for App. No. PCT/EP 00/128076 (mailed Feb. 26, 2003).
PCT Intl. Search Report for App. No. PCT/EP 01/00596 (mailed Jun. 15, 2001).
PCT Intl. Search Report for App. No. PCT/EP 02/02022 (mailed Jul. 9, 2002).
PCT Intl. Search Report for App. No. PCT/EP 02/04394 (mailed Sep. 27, 2002).
PCT Intl. Search Report for App. No. PCT/EP 03/05740 (mailed Oct. 30, 2003.
PTO Communication Mailed Jan. 23, 2008 in Response to Suggestion of Interference Filed Feb. 28, 2008, 10 pages.

* cited by examiner

MEASURING DEVICE

CROSS-REFERENCE TO RELATED APPLICATIONS

This application claims the priority of German application no. 10 2010 035 147.4, filed Aug. 23, 2010, and which is incorporated herein by reference.

FIELD OF THE INVENTION

The invention relates to a measuring device for in-process measurement of test pieces during a machining operation on a machine tool. The invention relates to a measuring device for in-process measurement of test pieces during a machining operation on a machine tool, in particular a grinding machine.

BACKGROUND OF THE INVENTION

In the manufacture of crankshafts, the crank pins of the crankshaft must be ground to size on a grinding machine. To ensure that the grinding operation is ended as soon as a desired size is reached, during the machining operation it is necessary to continuously check the crank pin, in particular with regard to its diameter and circularity, within the scope of an in-process measurement method. EP-A-0859689 discloses a measuring device of this type.

From EP-A-1370391 a measuring device of this type is known which is used for in-process measurement of crank pins during a grinding operation on a grinding machine. The known measuring device has a measuring head which is movable relative to a base body of the device between a neutral position and a measuring position in which the measuring head is in measuring contact with the test piece. In particular, in the known measuring device the measuring head is connected via a linkage to a base body of the measuring device so as to be pivotable about a first swivel axis. The known measuring device also has a means for swiveling the measuring head in or out of the measuring position. For carrying out an in-process measurement at a crank pin, the measuring head is swiveled by the means provided for this purpose into a measuring position in which the measuring head, for example using a measuring prism, comes to rest against the crank pin to be measured. During the grinding operation the crank pin undergoes an orbital rotation about the rotational axis of the crankshaft. The grinding wheel remains in contact with the crank pin, and for this purpose is movably supported radially with respect to the rotational axis of the crankshaft. To ensure that measurements may be carried out at the crank pin during the entire grinding operation, the measuring head follows the motions of the crank pin. For this purpose the base body of the measuring device is connected to a base body of the grinding machine, so that during the grinding operation the measuring device is moved in the radial direction of the crankshaft, synchronously with the grinding wheel of the grinding machine.

From EP 1 063 052 B1 a measuring device is known, in which a rotary encoder is provided at a connecting point at which the measuring head is connected to the base body of the measuring device via a linkage.

An object of the invention is to provide a measuring device for in-process measurement of test pieces during a machining operation on a machine tool, in which the risk of measurement inaccuracy is reduced.

This object is achieved by the measuring device according to the invention, including a measuring device for in-process measurement of test pieces during a machining operation on a machine tool, including a base body and a measuring head which is movable relative to the base body of the measuring device between a neutral position and a measuring position in which the measuring head is in measuring contact with the test piece. There is likewise an angle sensor which operates in a machine reference-free manner provided and associated with the measuring head for detecting an angular position of the measuring head relative to the test piece, during a measuring operation.

The measuring device according to the invention likewise includes a measuring device for in-process measurement of test pieces during a machining operation on a machine tool, including a base body and a measuring head which is movable relative to the base body of the measuring device between a neutral position and a measuring position in which the measuring head is in measuring contact with the test piece. There is likewise an angle sensor which operates in a machine reference-free manner provided and associated with the measuring head for detecting an angular position of the measuring head relative to the test piece, during a measuring operation, and the angle sensor detects changes in the angular position of the measuring head relative to the test piece.

The invention is based on the assumption that generally during the measuring operation the angular position of the measuring head relative to the test piece changes, for example a test piece in the form of a crank pin of a crankshaft, and the change in the angular position being an oscillating motion which corresponds to the kinematics of a linkage, for example, via which the measuring head is connected to the base body of the measuring device.

The only exceptions thereto are measuring devices in which the linkage is configured in such a way that during the measuring operation the angular position of the measuring head does not change relative to the test piece. In this case, while the test piece is rotated about its rotational axis, a measuring probe of the measuring head associates measured values, recorded at equal time intervals, with locations of the test piece which are equidistant in the circumferential direction.

On the other hand, if the angular position of the measuring head relative to the test piece changes, which is generally the case, measured values recorded at equal time intervals in the circumferential direction, for example, by the measuring probe do not correspond to circumferential locations of the test piece which are equidistant in the circumferential direction, and instead are shifted in the circumferential direction, corresponding to the oscillating angular position of the measuring head.

To determine the contour of the test piece, for example, the measured values must be corrected so that the corrected measured values correspond to equidistant circumferential locations of the test piece.

The invention is based on the concept of avoiding measurement errors which result from; i.e., in connection with, this correction.

In the device known from the prior art, the rotational position of a crankshaft is detected, and the correction of the angular position is determined by computer, using the kinematics of the measuring head specified by mechanical factors. This correction is based on the assumption that an angular position of the measuring head is uniquely associated with every rotational position of the crankshaft.

The invention departs from the concept of carrying out the correction by computer. Rather, it is based on the concept of detecting changes in the angular position of the measuring head relative to the test piece using an angle sensor which is adapted thereto and associated with the measuring head.

Accordingly, the invention provides that an angle sensor is associated with the measuring head for detecting the angular position of the measuring head, in particular changes in the angular position of the measuring head relative to the test piece, during a measuring operation.

In this manner, in particular changes in the angular position of the measuring head are detected by sensor. The changes in angular position detected by sensor may be included with high accuracy into the correction of the measured values or their association with circumferential locations of the test piece.

The measuring device according to the invention has the advantage in particular that changes in the kinematics of the measuring head, which are caused, for example, by wear of a linkage which connects the measuring head to the base body of the measuring device, or also which occur when the measuring device is modified for adjustment to a crankshaft having different dimensions, do not adversely affect correction of the association with the measured values. The accuracy of the correction of the association with the measured values may thus be increased.

Another advantage of the invention is that it may be used without modification when a component of a grinding machine to which the measuring device is attached moves during the measuring operation. Corresponding motions of the component bearing the measuring device, and thus motions of the measuring device, may be planned and desirable. However, the motions may also be random and undesirable. Regardless of the cause of the motions in question, they do not influence the measuring accuracy of the measuring device according to the invention since, thanks to the use of a dedicated sensor which is associated with the measuring head, changes in the angular position are detected regardless of their cause. The flexibility of the measuring device according to the invention is thus increased with regard to their use in cooperation with a machine tool.

According to the invention, it has been achieved that the measured values recorded by a measuring probe of the measuring head are evaluated by first compensating for or correcting the change in angular position of the measuring head relative to the test piece during the measuring operation. The compensated or corrected measured values may then be further processed for reconstructing the correction of the test piece, for example.

In particular, the angle sensor, which according to the invention is associated with the measuring head, is an angle sensor which operates in a machine reference-free manner. According to the invention, an angle sensor which operates in a machine reference-free manner is understood to mean an angle sensor which detects the angular position or changes in the angular position of the measuring head independently of a reference which is defined by the measuring device or the machine tool. Accordingly, sensors whose functional principle is based on interaction with a magnetic field or the earth's gravitational field angle, for example, are regarded as sensors which operate in a machine reference-free manner. In contrast, an angle sensor which does not operate in a machine reference-free manner is understood to mean a sensor which is known from the prior art and which is used to sense rotations of the test piece relative to the grinding machine so that, based on this information and known kinematics of the measuring head during the measuring operation, changes in the angular position of the measuring head are computed.

In principle, according to the invention it is sufficient for a single angle sensor to be associated with the measuring head. If necessary or desired, depending on the particular requirements, at least two angle sensors may also be associated with the measuring head.

Depending on the particular requirements and circumstances, the sensor principle; i.e., the principle underlying the sensor, of the angle sensor provided according to the invention may be selected within a broad range, as long as it is ensured that the angular position or changes in the angular position of the measuring head relative to the test piece during the measuring operation is/are determinable with an accuracy that is appropriate for the application.

In this regard, one advantageous further embodiment of the invention provides that the angle sensor is an inclination sensor. A corresponding inclination sensor is essentially an angle measuring device with reference to the surface of the earth, and measures the deviation from the horizontal or vertical. The reference is the earth's gravitational field, so that a corresponding sensor operates in a machine reference-free manner.

One extremely advantageous further embodiment of the invention provides that the angle sensor is an acceleration sensor. An acceleration sensor measures the acceleration, for example, by determining the inertial force acting on a test mass. According to the invention, the static or dynamic acceleration may be used for this purpose. One particular advantage of this embodiment is that corresponding acceleration sensors, which are also referred to as accelerometers, acceleration meters, and G sensors, are available as relatively small, versatile, and inexpensive standard components. Instead of acceleration sensors, according to the invention other inertial sensors may be used.

Another advantageous further embodiment of the invention provides that the angle sensor has a fiber gyro, also referred to as a fiber optical gyro or interferometer fiber optic gyroscope (IFOG). The operating principle of a fiber gyro is based on the interference of two light beams circulating in opposite directions in a wound glass fiber. In terms of function, such a fiber gyro is based on the principle of the Sagnac interferometer. Corresponding fiber gyros are likewise available as relatively inexpensive components. Since they do not operate in a completely drift-free manner during operation, calibration is necessary to ensure that the measuring results recorded during a measuring operation are not distorted by drift effects. Instead of a fiber gyro, a laser gyro may be used, the function of which is likewise based on the Sagnac effect. The mode of operation of a fiber gyro or laser gyro in particular is generally known to one of ordinary skill in the art, and therefore is not explained in greater detail herein.

Another embodiment which differs with regard to the operating principle of the sensor provides that the angle sensor is a magnetic field sensor. The operating principle of such a magnetic field sensor may, for example, be based on detection of the position of a permanent magnet which moves in a magnetic field generated by a coil. In other respects, the design of such magnetic field sensors is generally known to one of ordinary skill in the art, and therefore is not explained in greater detail herein.

In addition, further sensor principles may be used according to the invention. For example, an optical sensor system may be used, by means of which the angular position or changes in the angular position of the measuring head are optically detected. In this regard it is possible, for example, to detect changes in the angular position of the measuring head using an electronic camera, and to determine the changes in angular position from the output signal of the camera, using image processing algorithms. The configuration of the angle sensor or the angle sensors may be selected within a broad range, depending on the particular requirements. In this regard, one advantageous embodiment provides that the angle sensor is situated on the measuring device.

One extremely advantageous further embodiment of the invention provides that the angle sensor is situated on the measuring head or on a part of a linkage that is rigidly or practically rigidly connected to the measuring head, by means of which the measuring head is connected to the base body of the measuring device. In this embodiment, the angle sensor is directly connected to the measuring head or to a part of the linkage rigidly connected thereto. The greatest possible accuracy is thus achieved in detecting changes in the angular position of the measuring head, which is not affected by wear, for example of articulated connections of a linkage which connects the measuring head to the base body of the measuring device.

Another advantageous further embodiment of the invention provides that the angle sensor is connected to an evaluation device which determines the angular position or changes in the angular position of the measuring head relative to the test piece as a function of at least one output signal of the angle sensor.

Another advantageous further embodiment of the invention provides that a sensor which determines the particular rotational position of a test piece which rotates about a rotational axis during the measuring operation is connected to the evaluation device. If the test piece is a crankshaft, for example, which rotates about a rotational axis during a grinding operation, the particular instantaneous rotational position of the crankshaft may be sensed using an appropriate rotational position sensor. A corresponding signal may then be transmitted to the evaluation device, which, as a function of these output signals and the output signals of the angle sensor, establishes a unique association of measured values, which are recorded using a measuring probe of the measuring head, with corresponding circumferential locations of the crankshaft.

The invention is explained in greater detail below with reference to the accompanying highly schematic drawings which illustrate an embodiment of a measuring device according to the invention. In this regard, all features that are described, illustrated in the drawings, and claimed in the claims constitute the subject matter of the invention, taken alone or in any given combination, independently of their combination in the claims and their dependencies, and independently of their description or illustration in the drawings.

Relative terms such as left, right, up, and down are for convenience only and are not intended to be limiting.

DETAILED DESCRIPTION OF THE INVENTION

Figure 1:
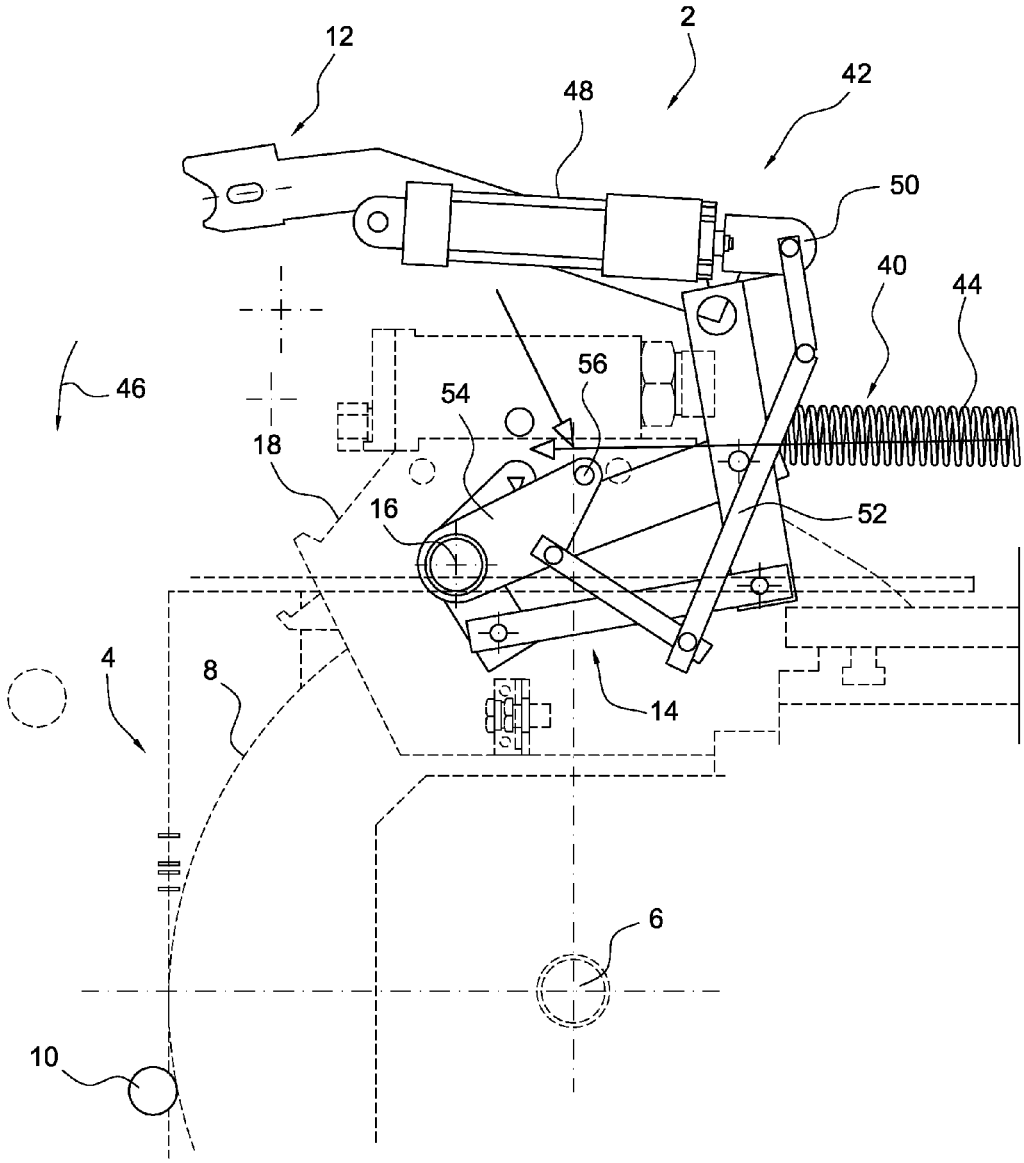
FIG. 1 shows in a highly schematic illustration a side view of an embodiment of a measuring device according to the invention in a neutral position of the measuring head.

FIG. 1 shows one embodiment of a measuring device 2 according to the invention which is used for the in-process measurement of test pieces during a machining operation on a grinding machine 4. The grinding machine 4, which for simplicity is only partially illustrated, has a grinding wheel 8 which is rotatable about a rotational axis 6 fixed to the machine, and which is used for machining a test piece, which in the present embodiment is formed by a crank pin 10 of a crankshaft.

The measuring device 2 has a measuring head 12 which is connected via a linkage 14 to a base body 18 of the measuring device 2 so as to be pivotable about a first swivel axis 16.

The measuring device 2 also has a device for swiveling the measuring head 12 in or out of the measuring position, as explained in greater detail below.

Figure 2A:
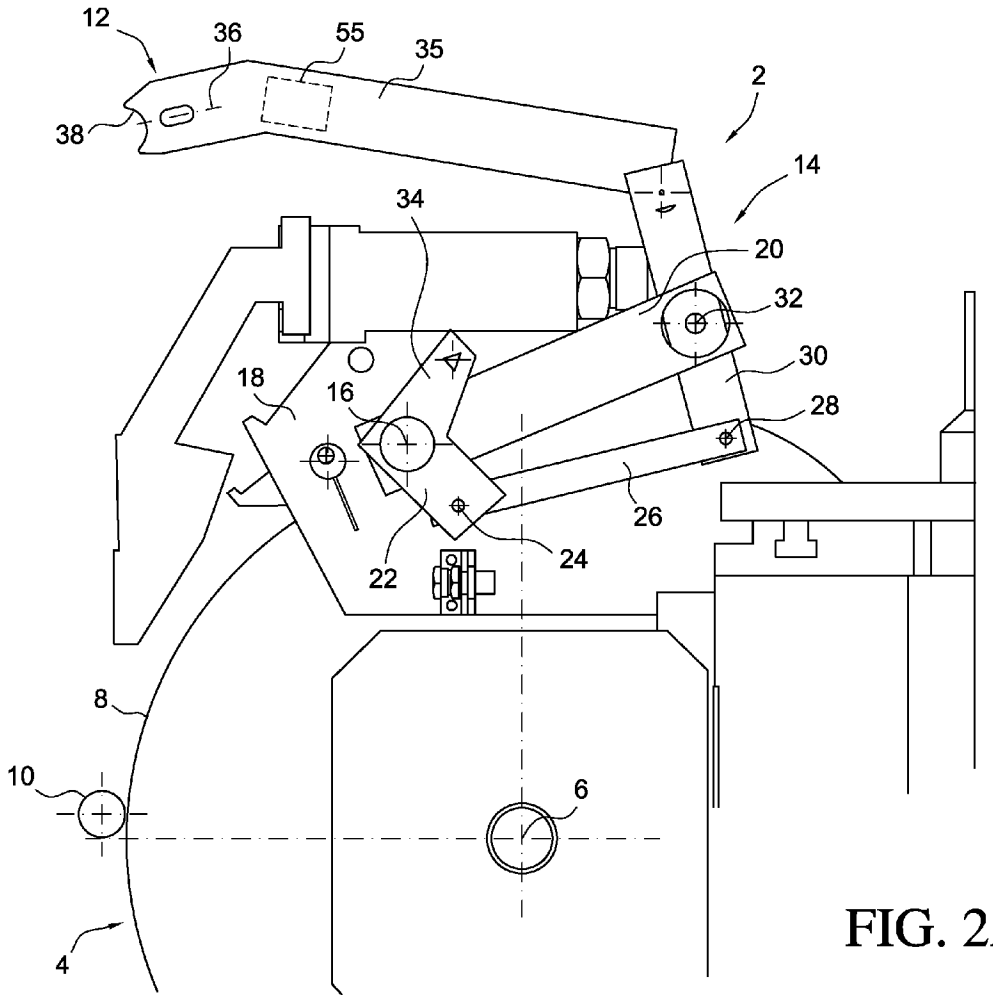
FIG. 2A through 2E show the measuring device according to FIG. 1 in various kinematic phases.

First, the configuration of the linkage 14 is explained in greater detail with reference to FIG. 2A. In FIG. 2A-2E, the device for swiveling the measuring head 12 in or out of the measuring position is omitted for the sake of clarity. The linkage 14 has a first linkage element 20 and a second linkage element 22 which are mounted so as to be pivotable about the first swivel axis 16. At the end of the second linkage element 22 facing away from the first swivel axis 16, a third linkage element 26 is connected which is pivotable about a second swivel axis 24, and whose end facing away from the second swivel axis 24 is connected to a fourth linkage element so as to be pivotable about a third swivel axis 28, the fourth linkage element being connected to the first linkage element 20, at a distance from the third swivel axis 28, so as to be pivotable about a fourth swivel axis.

In the illustrated embodiment, the first linkage element 20 and the third linkage element 26 are situated in a nonparallel manner with respect to one another, the distance between the first swivel axis 16 and the second swivel axis 24 being smaller than the distance between the third swivel axis 28 and the fourth swivel axis 32.

In the illustrated embodiment, the second linkage element 22 has a lever arm 34 configured such that the lever arm 34 together with the linkage element 22 forms a two-armed angle lever, whose function is explained in greater detail below.

In this embodiment, the measuring head 12 is situated on a holding arm 35 which is connected to the fourth linkage element 30 extending past the fourth swivel axis 32. In the illustrated embodiment, the connection between the holding arm 35 and the fourth linkage element 30 has a rigid design. It is apparent from FIG. 2A that in the illustrated embodiment a free end of the holding arm 35 which supports the measuring head 12 is angled toward the first swivel axis 16, wherein a portion of the holding arm 35 connected to the fourth linkage element 30 together with the fourth linkage element 30 define an angle greater than 90°.

In the illustrated embodiment, the measuring head 12 has a linearly deflectable measuring probe 36, indicated by a dashed line in FIG. 2A. In the illustrated embodiment the measuring head 12 also has a measuring prism 38. The manner in which circularity and/or dimension measurements are performed on a test piece, in particular a crank pin of a crankshaft or another cylindrical component, using a system composed of a linearly deflectable measuring probe 36 and a measuring prism 38, is generally known to one skilled in the art and therefore is not explained in greater detail herein.

The measuring device 2 also has a device for swiveling the measuring head 12 in and out which engages with the linkage 14, as explained in greater detail with reference to FIG. 1. In the illustrated embodiment, the device for swiveling the measuring head 12 in and out has a swivel-in device 40 and a separate swivel-out device 42.

In the illustrated embodiment, the swivel-in device 40 has a spring apparatus, which in the present embodiment has a spring 44, configured as a compression spring, which acts on the measuring head 12 via the linkage 14 in a swivel-in direction represented by an arrow 46 in FIG. 1. In the present embodiment, the spring 44 is configured as a compression spring, and at one end is supported on the base body 18 of the measuring device 2 and at the other end is supported on the lever arm 34, so that the spring 44 acts on the lever arm 34 in the counterclockwise direction in FIG. 1, and thus tends to move the measuring head 12 in the swivel-in direction 46 by means of the linkage 14.

In the present embodiment the swivel-out device 42 includes a hydraulic cylinder 48, the piston of which is connected at its free end to the base body 18 of the measuring device 2. The piston rod 50 of the hydraulic cylinder 48 is connected to a lever system 42, in the present embodiment configured as a toggle lever, whose free end facing away from the piston rod 50 is connected to a one-armed lever 54, which is supported coaxially with the swivel axis 16, in an eccentric manner with respect to the first swivel axis 16. At its free end the lever 54 has a journal 56, extending into the plane of the drawing, which loosely acts on the first linkage element 20 so that for a motion in a swivel-out direction which corresponds to a clockwise motion in the drawing, the lever 54 functions as a carrier for the first linkage element 20.

For sensing the particular position of the measuring head 12, a sensor device is provided which is in operative connection with a control device for controlling the swivel-in device 40 and the swivel-out device 42.

Measured values, which are recorded by the measuring probe 36 during a measuring operation, are evaluated using an evaluation device of an analytical computer. The manner in which corresponding measured values are evaluated is generally known to one of ordinary skill in the art and therefore is not explained in greater detail herein.

According to the invention, an angle sensor 55 for detecting the angular position of the measuring head 12, and in particular changes in the angular position of the measuring head 12 relative to the test piece (crank pin 10), is associated with the measuring head 12. In the illustrated embodiment, the angle sensor 55 is situated on the measuring device 2. In particular, the angle sensor 55 is connected to the holding arm 35, and therefore, to a part of the linkage 18 which is rigidly or substantially rigidly connected to the measuring head 12.

The angle sensor 55 is a sensor which operates in a machine reference-free manner, and which in the present embodiment is formed by an acceleration sensor which determines the static acceleration of the measuring head 12 with reference to gravitational acceleration. The inclination sensor may be based, for example, on a commercially available accelerometer, which is available, for example, under the name ADXL 322 from Analog Devices (www.analog.com). A corresponding electronic circuit biaxially determines the static acceleration in the X and Y directions. The particular angular position of the measuring head 12, and therefore also changes in the angular position, may be determined either by evaluating the output signal for only one measuring direction, for example using an arc sine relationship, or by evaluating both measuring directions, using an arc tangent relationship.

Since the angular position, and therefore also changes in the angular position of the measuring head 12, is/are thus not determined by means of a reference that is defined by the measuring device 2 or the grinding machine, changes in the kinematics, which result, for example, from wear of components of the linkage 18, do not adversely affect the accuracy of the measurement or evaluation. Likewise, the evaluation is not adversely affected when a component of the grinding machine 4 on which the measuring device 2 according to the invention is situated moves during the grinding operation.

Thus, according to the invention the reference for the angular measurement in the illustrated embodiment is exclusively the earth's gravitational field. If the machine bed of the grinding machine 4 moves during the grinding operation, for example due to an elastic bearing, corresponding motions may be measured using a second angle sensor. In the evaluation, the angle measured by the angle sensor 55 may be appropriately corrected by simple subtraction.

The mode of functioning of the measuring device 2 according to the invention is as follows:

In the neutral position illustrated in FIG. 1 and FIG. 2A, the measuring head 12 is disengaged from the crank pin 10. In this neutral position the hydraulic cylinder 48 is stopped, thus blocking a motion of the lever arm 34 in the counterclockwise direction in FIG. 1, which the compression spring 44 tends to bring about.

For swiveling the measuring head 12 in the swivel-in direction 46, the hydraulic cylinder 48 is activated in such a way that its piston rod 50 travels to the right in FIG. 1. When the piston rod 50 is extended, the spring 44 presses against the lever arm 34, so that the lever arm 34 is swiveled in the counterclockwise direction in FIG. 1. Since the lever arm 34 is connected to the second linkage element 22 in a rotationally fixed manner, the second linkage element 22, and therefore the entire linkage 14, is swiveled in the counterclockwise direction in FIG. 1.

Figure 2B:
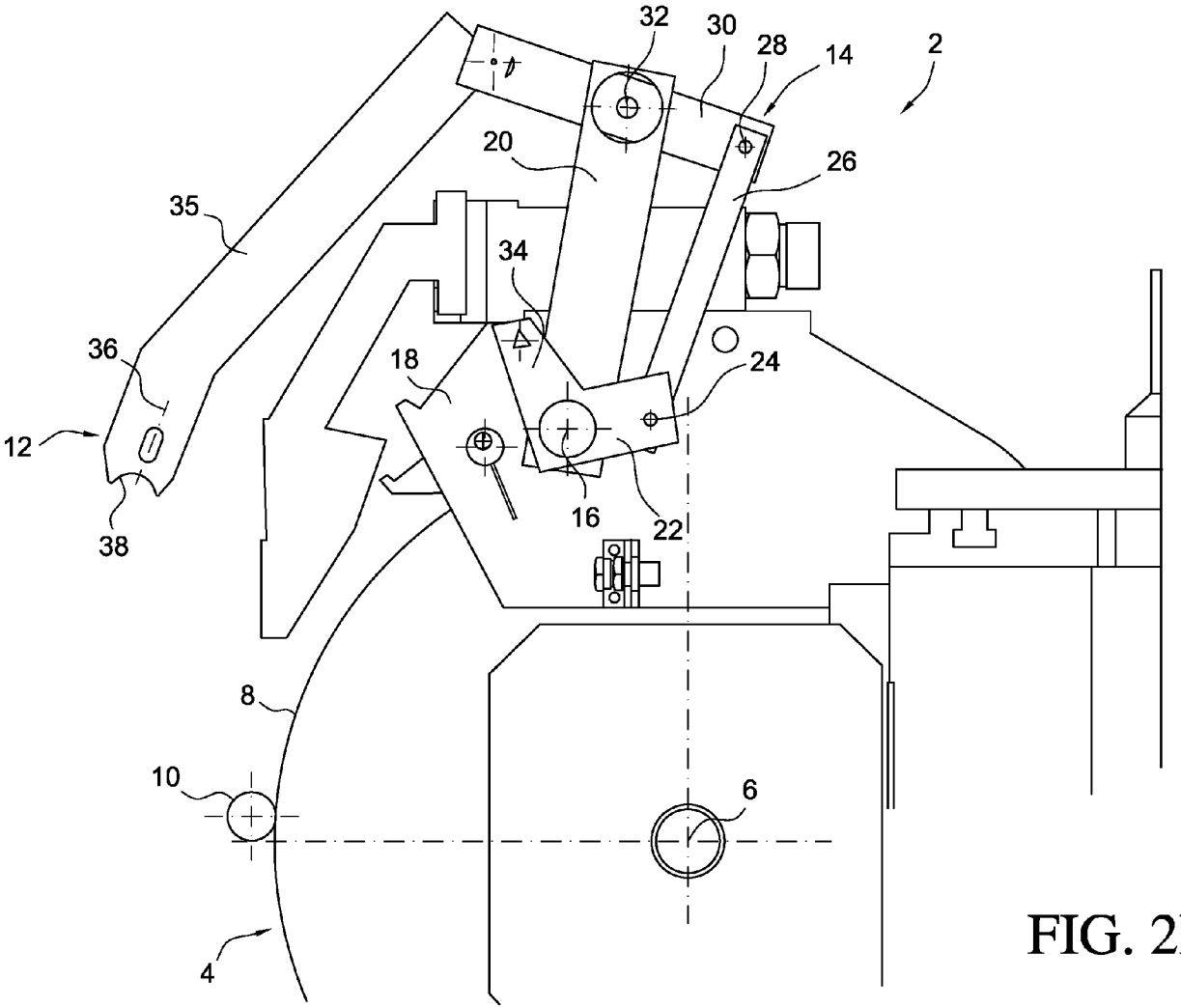

FIG. 2B shows the measuring head 12 in a position between the neutral position and the measuring position.

Figure 2C:
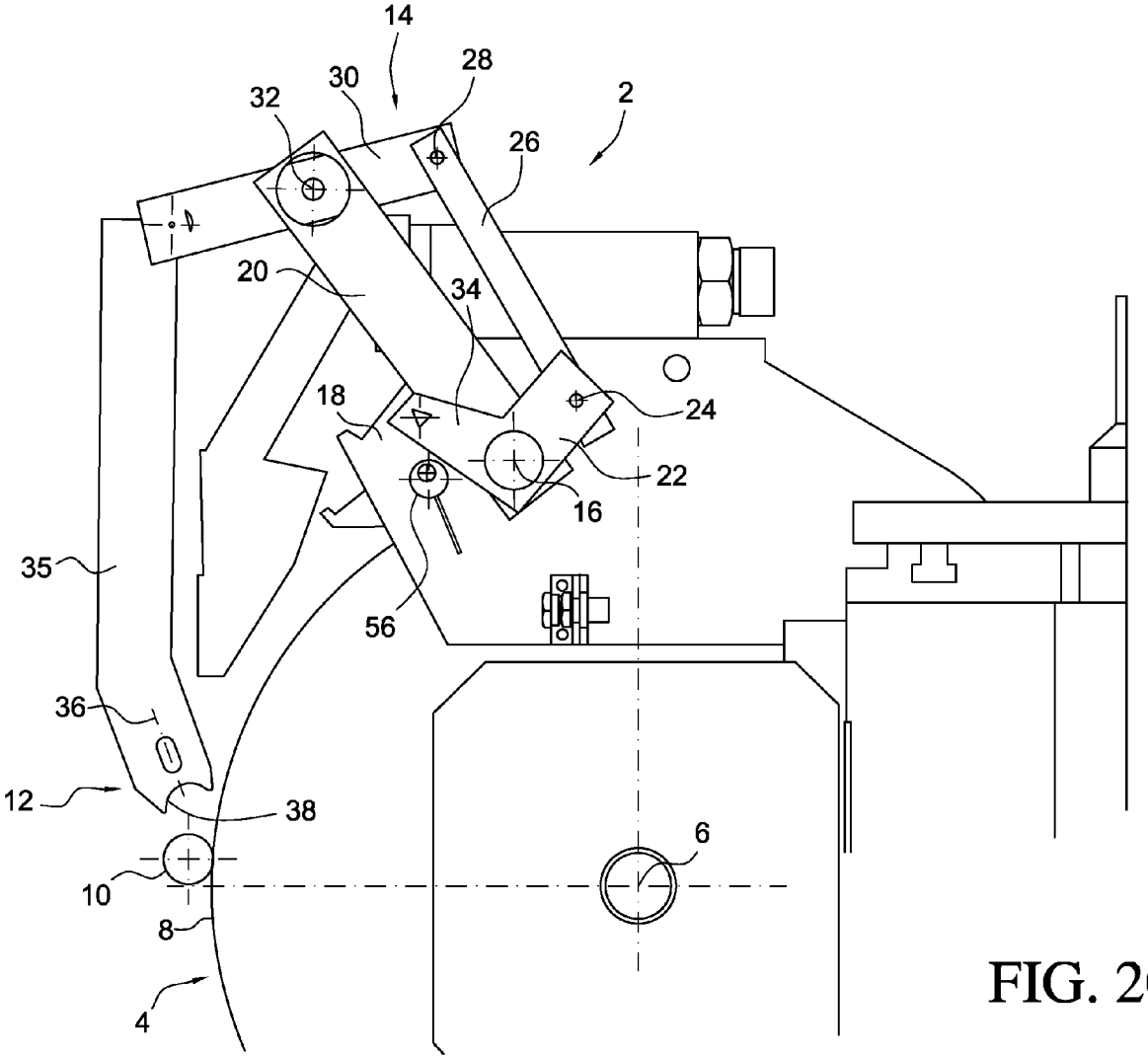

When a predetermined angular position illustrated in FIG. 2C is reached, the lever arm 34 strikes a stop 56; when the lever arm 34 strikes the stop 56 a control signal is transmitted to the control device, causing the hydraulic cylinder 48 to stop. FIG. 2C shows the measuring head 12 in a search position in which it is not yet in contact with the crank pin 10.

Figure 2D:
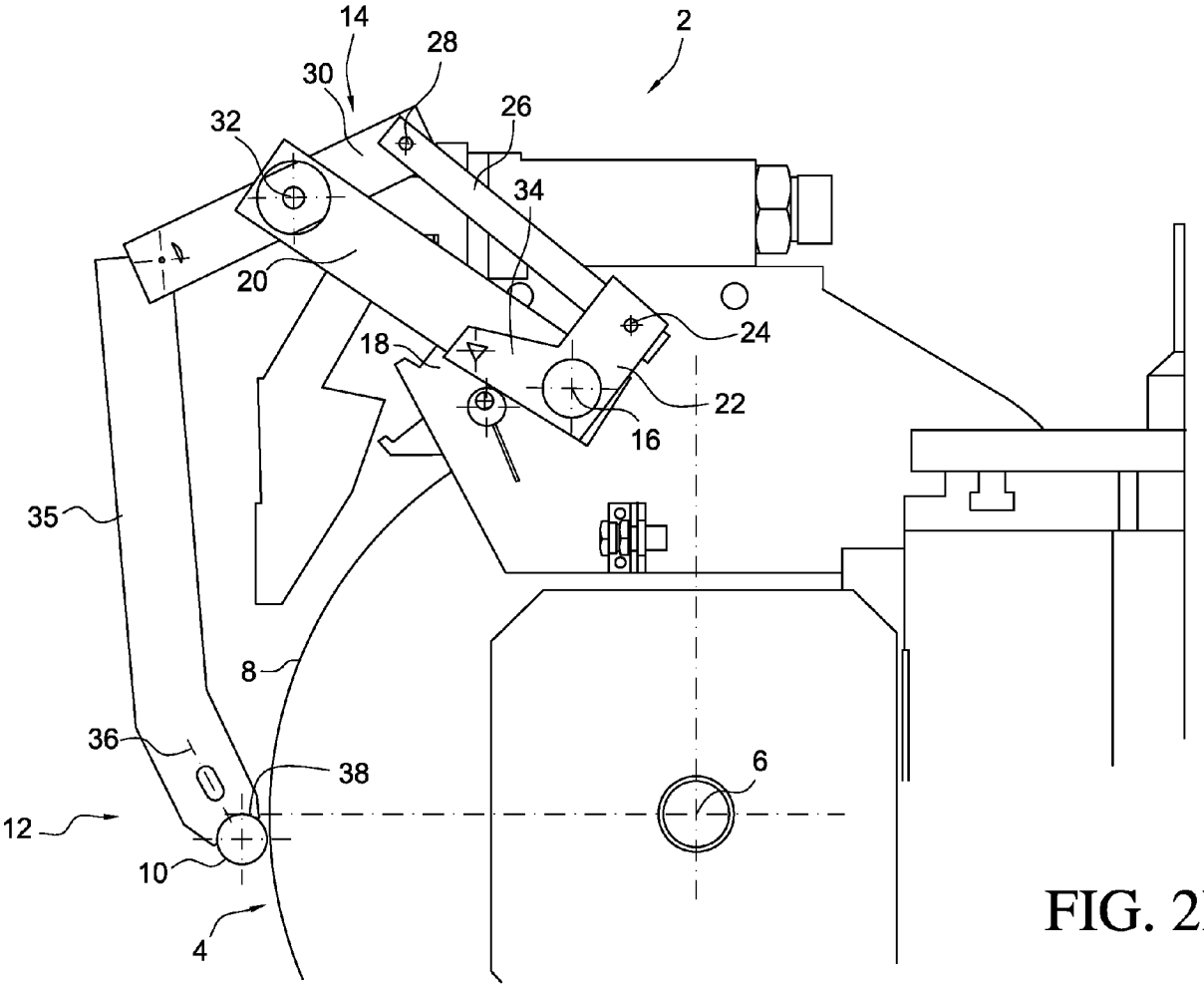

FIG. 2D shows the measuring head 12 in its measuring position, in which it is in contact with the crank pin 10.

Figure 2E:
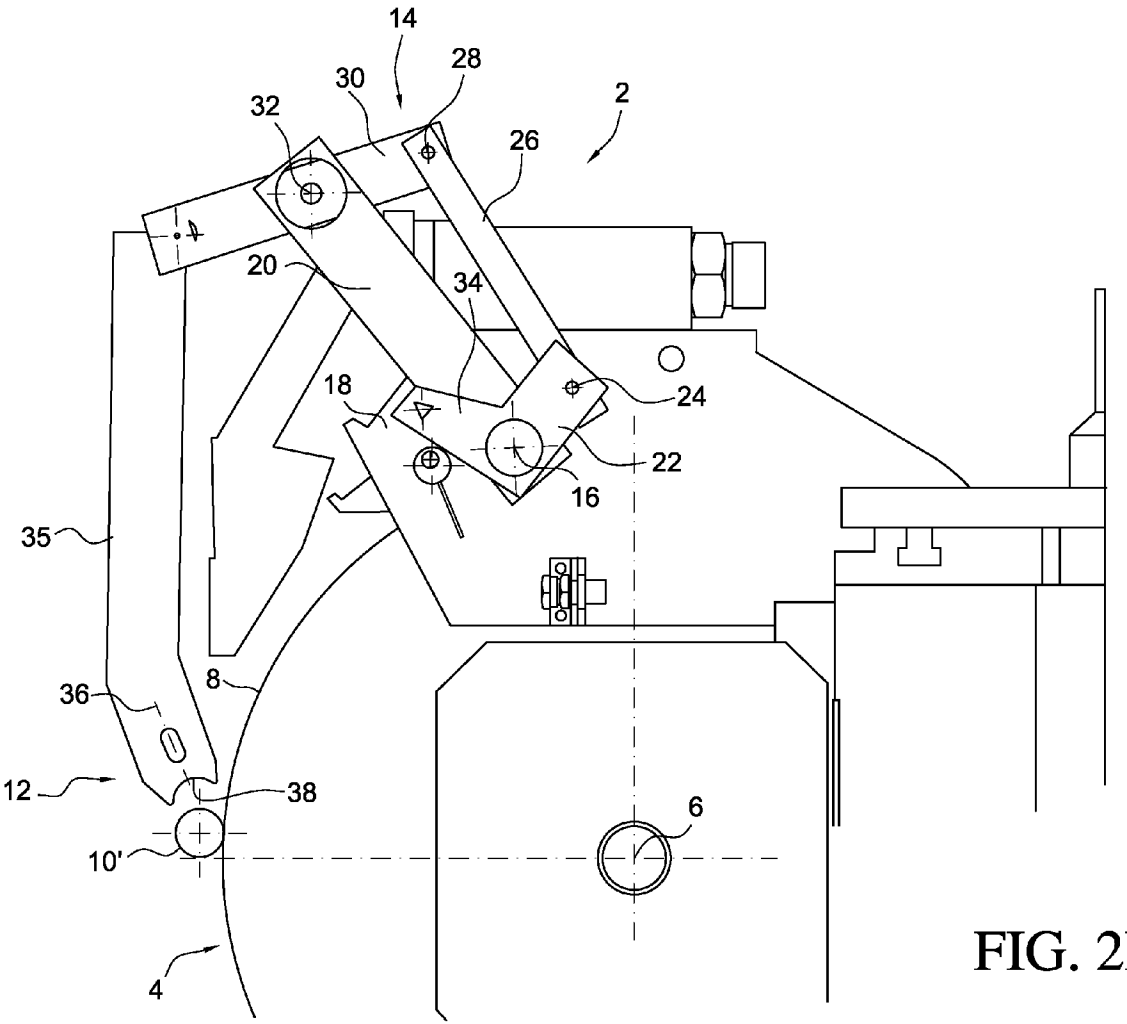

FIG. 2E corresponds to FIG. 2C, the measuring head 12 being illustrated in its search position with respect to a crank pin 10' of larger diameter.

Figure 3:
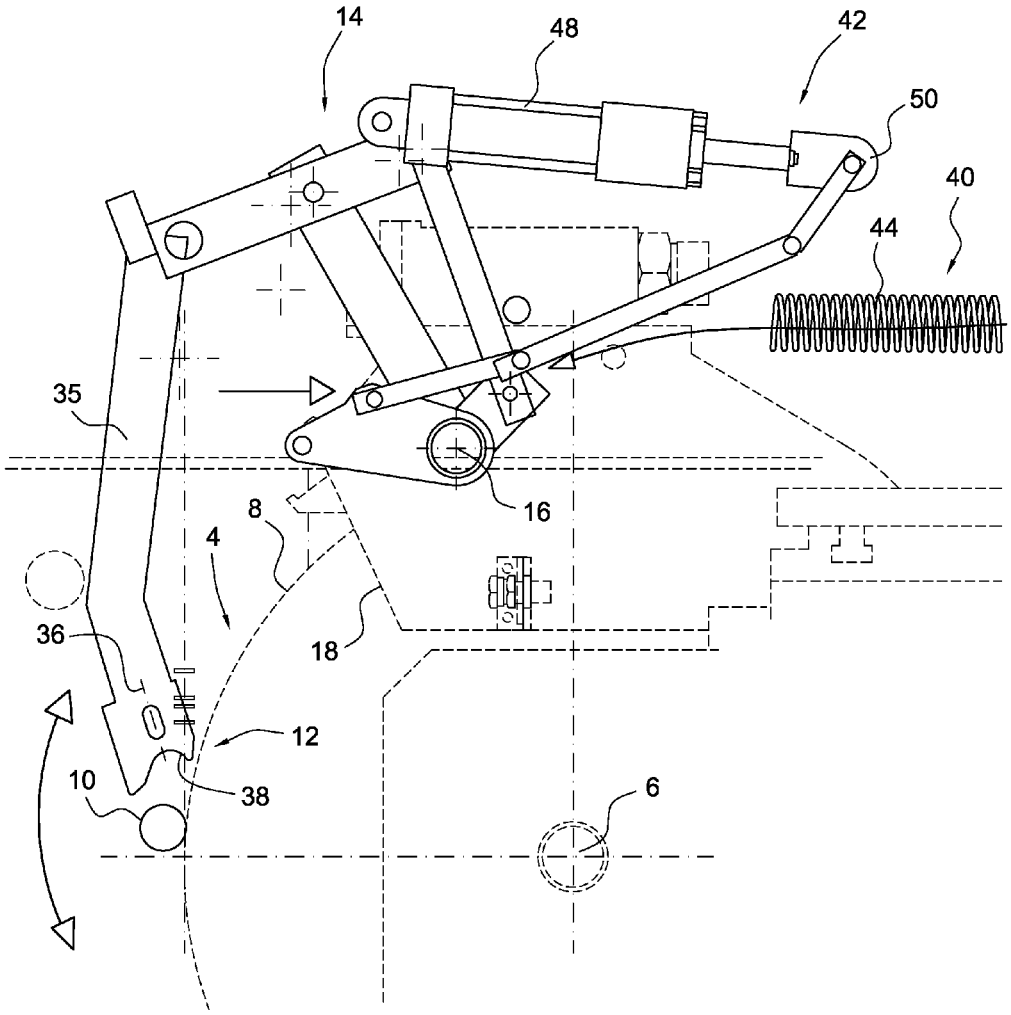
FIG. 3 shows, in the same illustration as FIG. 1, the embodiment according to FIG. 1 during the motion of the measuring head into the measuring position.

FIG. 3 shows the measuring device 2 in the search position of the measuring head 12, which is also illustrated in FIG. 2C. As is apparent from a comparison of FIG. 1 and FIG. 3, the lever 54 is swiveled in the counterclockwise direction in FIG. 1 by way of the lever system 42 when the piston rod 50 of the hydraulic cylinder 48 is extended, until the angular position of the lever 54 illustrated in FIG. 3 is reached. As shown in FIG. 3, in this angular position the roller 56 is situated at a distance from the first linkage element 20 in the circumferential direction of the first rotational axis 16, so that the first linkage element 20, and therefore the entire linkage 14 is able to move freely under the effect of the weight of the measuring head 12, including the holding arm 35, and the force exerted by the spring 44. In the measuring position (see FIG. 2D) the measuring head 12 contacts the crank pin 10, the measuring head following orbital rotations of the crank pin 10 about the crankshaft during the grinding operation. For this purpose, the base body 18 of the measuring device 2 is connected to a mounting of the grinding wheel 8 in a displaceably fixed manner so that the measuring device 2 follows translatory motions of the grinding wheel 8 in the radial direction of the rotational axis 6.

During the contact of the measuring head 12 with the crank pin 10 the measuring probe 36 records measured values, on the basis of which the circularity and/or the diameter of the crank pin may be assessed in the analytical computer downstream from the measuring probe 36. When, for example, a specified size of the diameter is reached, the grinding wheel 8 is disengaged from the crank pin 10.

In order to swivel out the measuring head 12 in the direction opposite the swivel-in direction 46, when the measurement is completed, the control unit activates the hydraulic cylinder 48 in such a way that its piston rod 50 moves to the left in FIG. 3. This causes the lever 54 to be swiveled in the clockwise direction in FIG. 3 by way of the lever system 42. As long as the roller 56 is situated at a distance from the linkage element 20 in the circumferential direction of the first swivel axis 16, the measuring head 12 initially remains in the measuring position. When the roller 56 comes into contact with the first linkage element 20 upon further swiveling of the lever 54 in the clockwise direction in FIG. 3 about the swivel axis 16, the lever 54 functions as a carrier upon further swiveling in the clockwise direction and carries the first linkage element 20, and therefore the entire linkage 14, in the clockwise direction, so that the measuring head is swiveled out in the direction opposite the swivel-in direction 46 until the neutral position illustrated in FIG. 1 is reached.

During the measuring operation, the measuring head moves in the circumferential direction of the crank pin 10 with an angular stroke, which in the illustrated embodiment is between about −7° and +5°, i.e., 12° total.

Identical or corresponding components are provided with the same reference numerals in the figures of the drawing. FIGS. 2A through 2E show a variant which has a slightly modified configuration with respect to the embodiment according to FIG. 1 and FIG. 3, which, however, is consistent with the embodiment according to FIG. 1 and FIG. 3 with regard to the basic principle of the invention.

The orbital rotations of the crank pin 10 about the rotational axis of the crankshaft are detected using a rotational position sensor 57 which is associated with the rotational axis of the crankshaft.

If the angular position of the measuring head 12 relative to the crank pin 10 were unchanged during the measuring operation, measured values recorded at equal time intervals by the measuring probe 36 of the measuring head 12 would correspond to circumferential locations of the crank pin 10 which are equidistant in the circumferential direction. Due to the change in angular position of the measuring head 12, in the illustrated embodiment of the measuring device 2 the measured values recorded at equal time intervals do not correspond to circumferential locations of the crank pin 10 which are equidistant in the circumferential direction, and instead are shifted corresponding to the change in angular position.

According to the invention, this shift is corrected or compensated for as follows:

Beginning at a starting position in which the measuring head 12 has a predetermined rotational position relative to the crank pin 10, during the orbital rotation of the crank pin 10 about the rotational axis of the crankshaft the measuring probe of the measuring head 12 continuously, in particular at equal time intervals, records measured values, which are delivered to an evaluation device.

Figure 4:
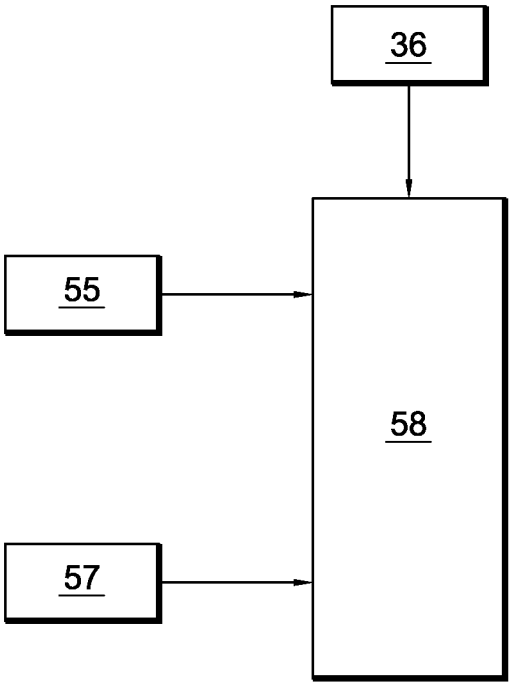
FIG. 4 shows a schematic block diagram for illustrating the cooperation of the angle sensor according to the invention with an evaluation device.

FIG. 4 schematically illustrates the evaluation device, which is denoted by reference numeral 58. The measuring probe 36 is likewise illustrated in FIG. 4.

During the measuring operation the angular position of the measuring head 12 relative to the crank pin 10 changes, and the associated changes in angular position are detected by the angular position sensor 53, whose output signals are delivered to the evaluation device 58. The output signals of the rotational position sensor 57, which is associated with the rotational axis of the crankshaft, are likewise delivered to the evaluation device 58, as illustrated in FIG. 4.

Based on the changes in the angular position which are thus determined in a highly accurate and machine reference-free manner, the evaluation device 58 corrects the association of the measured values, recorded at equal time intervals, of the measuring probe 60 in such a way that these measured values are associated with the circumferential locations of the crank pin 10 in a correctly positioned manner.

Since the change in angular position of the measuring head relative to the test piece is determined in a machine reference-free and absolute manner, the accuracy of the correction is no longer a function of the degree to which the kinematics of the measuring head 12, specified by the linkage 18, during the measuring operation correspond to assumed kinematics. A deviation in the actual kinematics from the assumed kinematics, for example due to wear of components of the linkage 18, does not influence this correction, or accordingly, the measuring accuracy.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

What is claimed is:

1. Measuring device for in-process measurement of test pieces during a machining operation on a machine tool, comprising:

a) a base body;

b) a measuring head which is movable relative to the base body of the measuring device between a neutral position and a measuring position in which the measuring head is in measuring contact with a test piece;

c) an angle sensor which operates in a machine reference-free manner provided and associated with the measuring head for detecting an angular position of the measuring head relative to the test piece, during a measuring operation, the angle sensor includes an acceleration sensor, and the acceleration sensor determines the static acceleration of the measuring head with reference to gravitational acceleration;

d) the angle sensor detects changes in the angular position of the measuring head relative to the test piece;

e) the angle sensor includes an accelerometer which delivers at least one output signal;

f) an evaluation device which determines the angular position of the measuring head relative to the test piece as a function of the at least one output signal of the accelerometer delivered to the evaluation device; and g) the angle sensor is connected to the evaluation device.

2. Measuring device according to claim 1, wherein:

a) the angle sensor includes an inclination sensor.

3. Measuring device according to claim 1, wherein:

a) the angle sensor is provided on the measuring device.

4. Measuring device according to claim 1, wherein:

a) the angle sensor is provided on the measuring head.

5. Measuring device according to claim 1, wherein:

a) the angle sensor is provided on a part of a linkage substantially rigidly connected to the measuring head, by which the measuring head is connected to the base body of the measuring device.

6. Measuring device according to claim 1, wherein:

a) a sensor is provided which determines a particular rotational position of a test piece which rotates about a rotational axis during a measuring operation, the sensor delivers at least one output signal, the sensor is connected to the evaluation device, and the at least one output signal is delivered to the evaluation device.

7. Measuring device according claim 2, wherein:

a) the inclination sensor includes an accelerometer; and b) an electronic circuit biaxially determines the static acceleration in the X and Y directions.

8. Measuring device according to claim 5, wherein:

a) a sensor is provided which determines a particular rotational position of a test piece which rotates about a rotational axis during a measuring operation, the sensor delivers at least one output signal, the sensor is connected to the evaluation device, and the at least one output signal is delivered to the evaluation device.

9. Measuring device according to claim 4, wherein:

a) a sensor is provided which determines a particular rotational position of a test piece which rotates about a rotational axis during a measuring operation, the sensor delivers at least one output signal, the sensor is connected to the evaluation device, and the at least one output signal is delivered to the evaluation device.

10. Measuring device according to claim 3, wherein:

a) a sensor is provided which determines a particular rotational position of a test piece which rotates about a rotational axis during a measuring operation, the sensor delivers at least one output signal, the sensor is connected to the evaluation device, and the at least one output signal is delivered to the evaluation device.

* * * * *